US005743634A

United States Patent [19]

Sitzema et al.

[11] Patent Number: 5,743,634

[45] Date of Patent: Apr. 28, 1998

[54] PERFORATED REFLECTOR FOR AN ORNAMENTAL LUMINAIRE

[75] Inventors: Ronald L. Sitzema, Ellsworth; Joel E. Robinson, Charlevoix; Robert D. Towne, Jr., Boyne City, all of Mich.

[73] Assignee: Lexalite International Corporation, Charlevoix, Mich.

[21] Appl. No.: 688,833

[22] Filed: Jul. 31, 1996

[51] Int. Cl.[6] ..... F21V 7/00; F21V 3/00

[52] U.S. Cl. ..... 362/341; 362/347; 362/348; 362/349; 362/350; 362/296; 362/310; 362/317

[58] Field of Search ..... 362/341, 296, 362/299, 300, 301, 302, 303, 304, 305, 306, 307, 310, 317, 347, 348, 349, 350, 327, 328, 329, 290, 410, 414, 257

[56] References Cited

U.S. PATENT DOCUMENTS

| | | | |
|---|---|---|---|
| 192,321 | 6/1877 | Baker | 362/341 |
| 1,368,674 | 2/1921 | Wohlauer | 362/307 |
| 1,637,429 | 8/1927 | Stewart | 362/303 |
| 1,640,423 | 8/1927 | O'Neil | 362/296 |
| 1,824,047 | 9/1931 | Goldfinger | 362/301 |
| 1,947,344 | 2/1934 | Lang | 362/304 |
| 2,066,631 | 1/1937 | Gorre | 362/303 |
| 2,138,373 | 11/1938 | Doane | 362/414 |
| 2,218,291 | 10/1940 | Muller | 362/350 |
| 3,113,729 | 12/1963 | Koller | 362/257 |
| 3,334,221 | 8/1967 | Aslund | 362/257 |
| 3,395,273 | 7/1968 | Welty | 362/334 |
| 3,712,980 | 1/1973 | Norton | 359/589 |
| 4,072,856 | 2/1978 | Eligehausen | 362/343 |
| 4,434,455 | 2/1984 | Merritt | 362/307 |
| 4,694,382 | 9/1987 | Sales | 362/347 |
| 4,719,548 | 1/1988 | Orosz | 362/334 |
| 4,789,923 | 12/1988 | Sales | 362/347 |
| 4,839,781 | 6/1989 | Barnes et al. | 362/299 |
| 5,046,818 | 9/1991 | Barnes | 359/527 |
| 5,143,446 | 9/1992 | Barnes et al. | 362/293 |
| 5,402,328 | 3/1995 | Pardo | 362/255 |
| 5,481,445 | 1/1996 | Sitzema | 362/308 |

*Primary Examiner*—Stephen F. Husar
*Assistant Examiner*—Matthew Spark
*Attorney, Agent, or Firm*—Mason, Kolehmainen, Rathburn & Wyss

[57] ABSTRACT

In brief, the objects and advantages of the present invention are achieved by a reflector for an ornamental luminaire. The reflector includes a member formed of a metal material, the metal member having a predetermined thickness and being perforated with spaced apart apertures of a selected diameter and selected density. The metal member has a predefined reflector shape with the spaced apart apertures and the predefined reflector shape arranged to provide control of both an upper illumination distribution and a lower illumination distribution. The reflector metal member includes a plurality of positioning portions arranged for press-fit engagement within the ornamental luminaire. A hydroforming technique is used to form the metal member into the predefined reflector shape. The reflector is trimmed via a stamping process to a desired diameter and to provide the plurality of positioning portions in a precompression state. The positioning portions are sized to deform into an outwarding extending ledge on the interior surface of the lower ornamental luminaire body.

12 Claims, 8 Drawing Sheets

PERFORATED REFLECTOR FOR AN ORNAMENTAL LUMINAIRE

FIELD OF THE INVENTION

The present invention relates generally to reflectors, and more particularly to a perforated reflector for an ornamental luminaire used for outdoor lighting.

DESCRIPTION OF THE PRIOR ART

Ornamental post top luminaires that do not include reflectors often tend to over illuminate to compensate for a percent upward component, in order to achieve the illumination requirements for the roadway. The tendency is to simply over lamp or over illuminate the environment without taking into account the glare being generated by each luminaire.

Various arrangements are known for reflectors. A traditional type of ornamental roadway luminaire with a totally enclosing metal or metalized plastic reflector typically causes the total direct illumination otherwise directed above the 90 degrees horizontal plane to be reflected into the lower body portion of the luminaire and eliminates nearly all the uplight component. While this type of reflector decreases the number of luminaires required to illuminate a roadway or pathway, the outline or the apparent size of the luminaire is significantly reduced and the illumination is concentrated into a smaller area of the luminaire, causing an increased apparent brightness in the luminaire and creating intense illumination and glare in the lower portion of the luminaire. This allows many of these type luminaires to achieve specific illumination values on the street, while creating harsh shadows in the underside of foliage and creating distinct cutoff shadows on building fronts that may line the street.

To achieve an uplight component, one known street luminaire includes an integrally formed reflector with an opening positioned directly above a light bulb to allow light leakage into the uplight zone above 90 degrees horizontal. In such luminaires that have utilized a baffle-type reflector to meet street illumination values, enough illumination may be reflected into the lower refractor body, while typically without specific control of the uplight component. In general, little or no control of the upward component is achieved in the opening area of the reflector aperture. While such arrangements are somewhat effective, a problem of non-uniform, localized illumination in the top of the ornamental globe and localized heat result. The resulting light distribution of such arrangements tends to provide sharp cutoff lines on the front of buildings lining the streets and localized intense contrasts of shadows and contrasts on the underside of tree foliage.

Another alternative reflector is provided by using precisely cut internal reflection optics onto a reflector contour. This type of reflector must be manufactured in transparent, clear plastic or glass if it is to be efficient and effective; but it has limitations as to the size of the prism being machined into the tool or mold. In these reflectors the uplight component is a by-product of the losses within the individual prisms. Changes to the uplight component can only be manipulated by an expensive remachining of the tool that forms the reflector, or tinting the substrate material or the addition of a translucent cover over the exterior of the reflector.

U.S. Pat. No. 4,839,781 issued to Josh T. Barnes and Ronald L. Sitzema Jun. 13, 1989, discloses a reflector device for use with a variety of lighting fixtures and light sources. The reflector has a predetermined profile and predefined sectional zones. Each sectional zone has predetermined light distribution characteristics. The reflector provides a predetermined light distribution characteristic by a vertical movement of an illuminating lamp source.

U.S. Pat. No. 5,046,818 issued to Josh T. Barnes Sep. 10, 1991, discloses an optical system for traffic signal devices including a reflector and a lens.

U.S. Pat. No. 5,481,445 issued to Ronald L. Sitzema et al., Jan. 2, 1996, discloses a transflection reflector including a body for simultaneously reflecting and transmitting light rays. The body is formed by a plurality of layers of a polymeric reflective material and has reflected rays at each interface between adjacent ones of the multiple layers. The body is both selectively configured and positioned relative to a light source for a predetermined distribution of reflected and transmitted rays.

While the reflectors disclosed by the above-identified patents provide improvements over prior art arrangements, it is desirable to provide an improved reflector that avoids the need for internal reflection prisms and for the use of a polymeric reflective material.

SUMMARY OF THE INVENTION

Important objects of the present invention are to provide an improved reflector for an ornamental luminaire; to provide such an improved perforated metal reflector making possible a simplified, less expensive and easily manufactured reflector providing effective and efficient operation; and to provide such an improved reflector overcoming many of the disadvantages of known reflectors.

In brief, the objects and advantages of the present invention are achieved by a reflector for an ornamental luminaire. The reflector includes a member formed of a metal material, the metal member having a predetermined thickness and being perforated with spaced apart apertures of a selected diameter and selected density. The metal member has a predefined reflector shape with the spaced apart apertures and the predefined reflector shape arranged to provide control of both an upper illumination distribution and a lower illumination distribution.

In accordance with features of the invention, the reflector metal member includes a plurality of positioning tab portions arranged for press-fit engagement within the ornamental luminaire. A hydroforming technique is used to form the metal member into the predefined reflector shape. The reflector is trimmed via a stamping process to a desired diameter and to provide the plurality of positioning tab portions in a precompression state. The positioning portions are sized to deform into an outwarding extending ledge on the interior surface of the lower ornamental luminaire body.

BRIEF DESCRIPTION OF THE DRAWING

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

Figure 1:
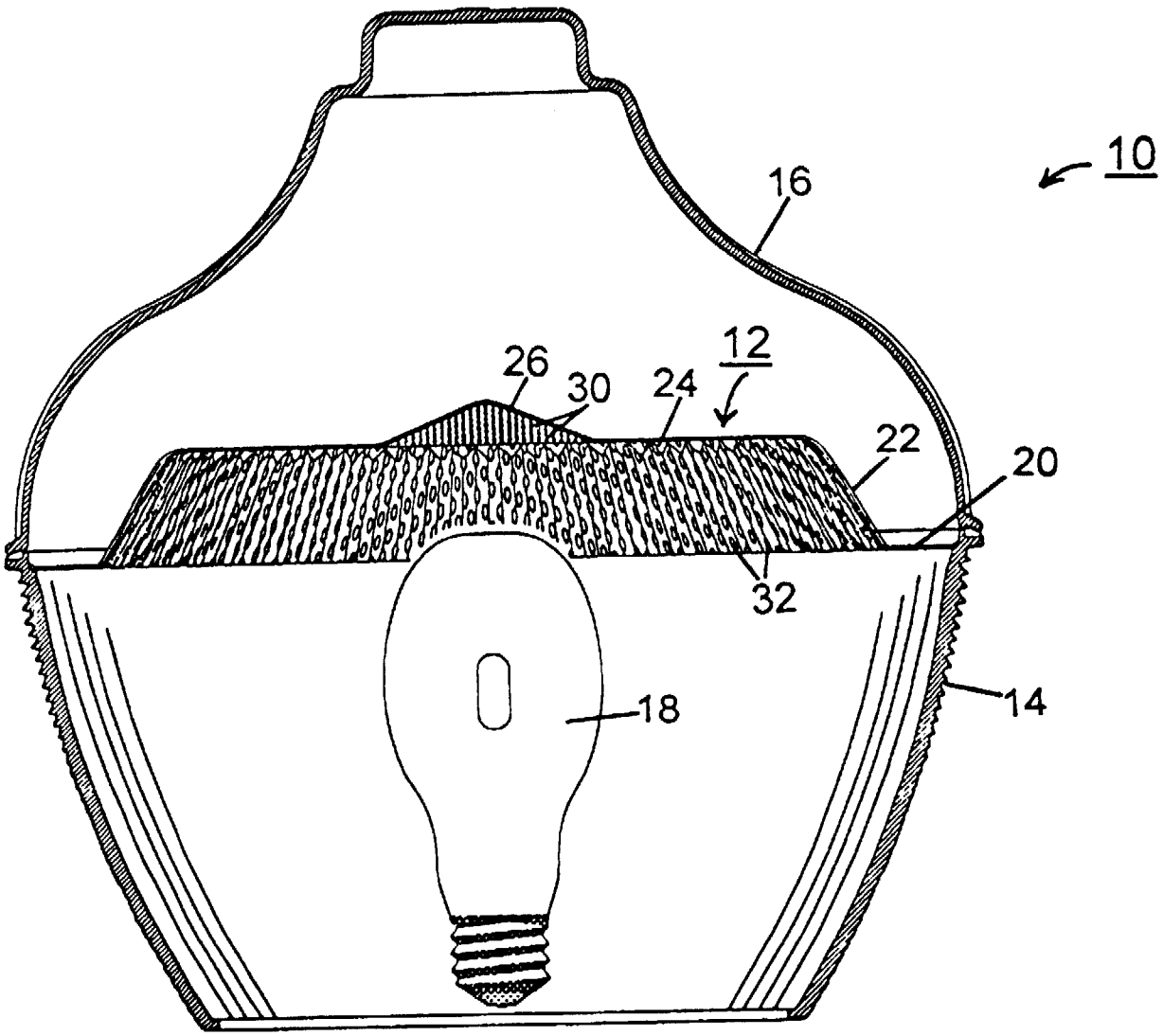
FIG. 1 is a sectional view of an ornamental roadway luminaire together with a perforated reflector in accordance with the present invention.

Having reference now to the drawings, in FIG. 1 there is shown an ornamental luminaire 10 together with a perforated reflector generally designated by the reference character 12 in accordance with the present invention. Ornamental luminaire 10 includes a refractor 14 for its lower body, an ornamental-shaped top 16 for its upper body, and a lamp 18.

In accordance with a feature of the invention, the perforated reflector 12 has a predefined reflector shape with the spaced apart apertures and the predefined reflector shape arranged for providing control of both an upper illumination distribution and a lower illumination distribution. Once the perforated reflector 12 is positioned in place within the ornamental luminaire 10, an uplight component is reduced uniformly, but significantly, while the downlight component is effectively increased.

Figure 2:
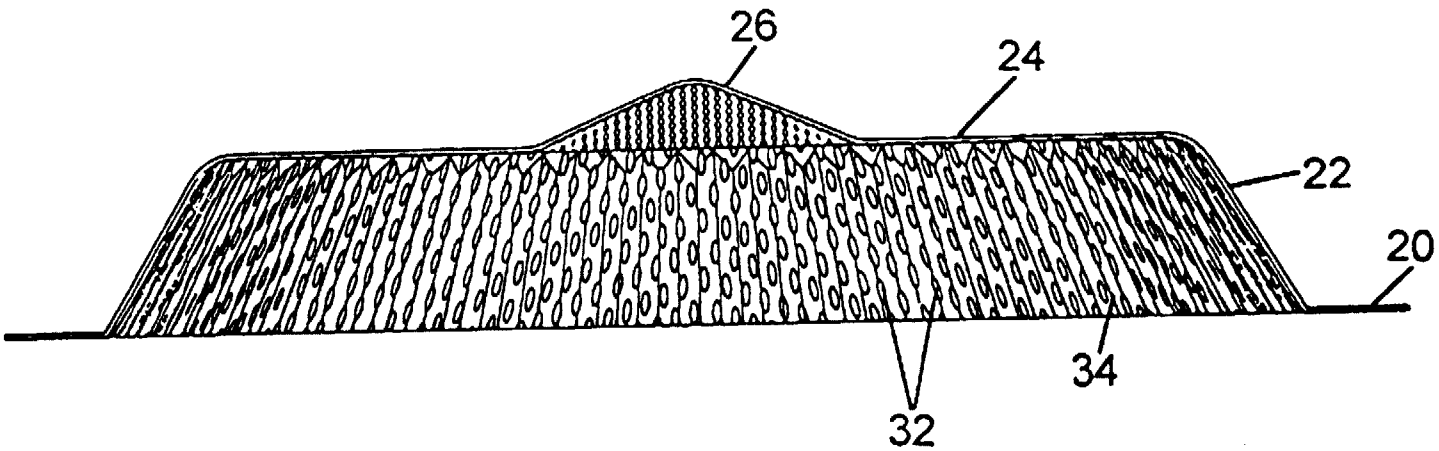
FIG. 2 is a side view of the perforated reflector in accordance with the present invention of FIG. 1.
Figure 3:
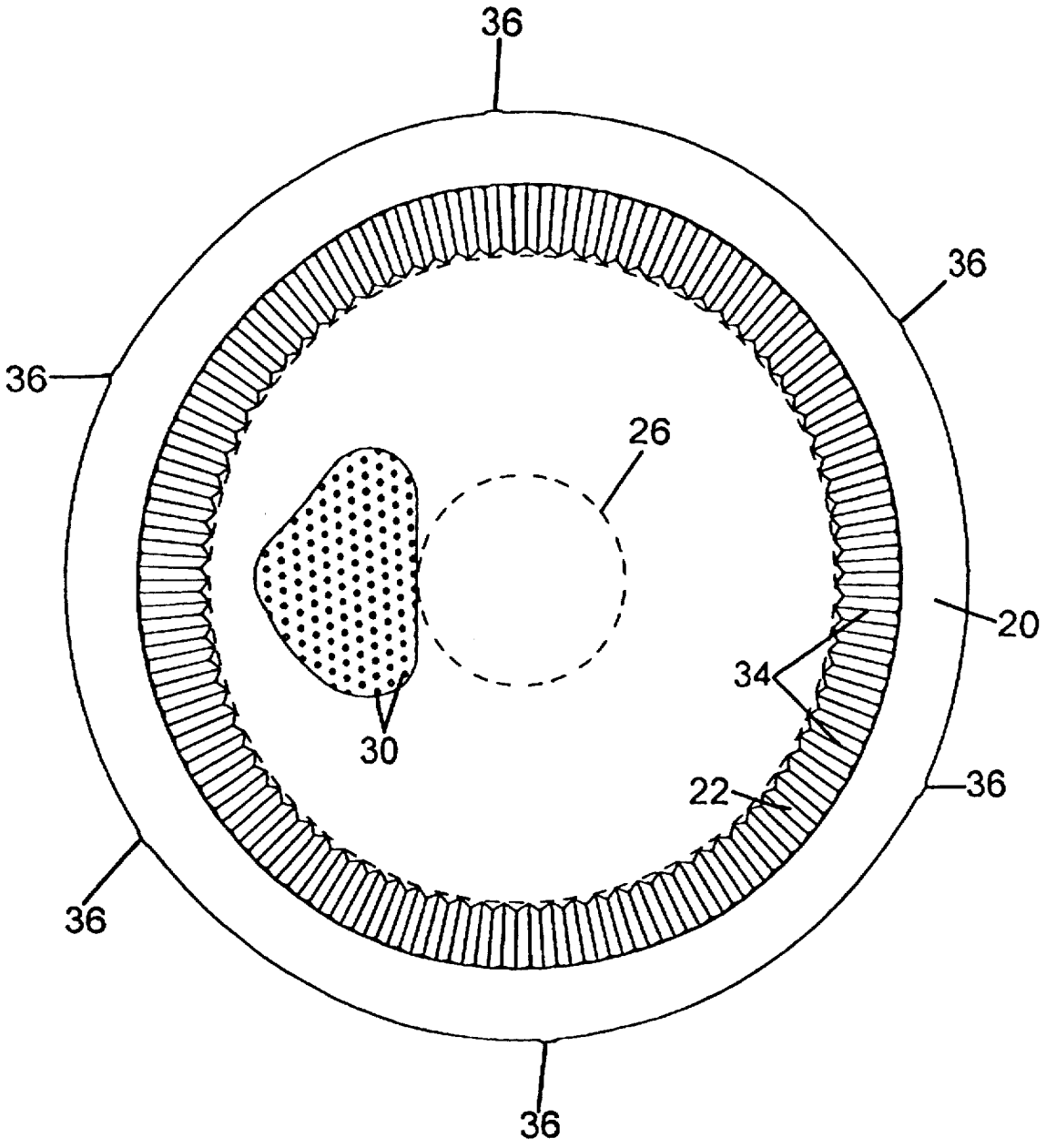
FIG. 3 is a partly schematic top plan view of the perforated reflector including a only detailed portion showing perforations which included throughout the entire perforated reflector in accordance with the present invention of FIG. 1.
Figure 4:
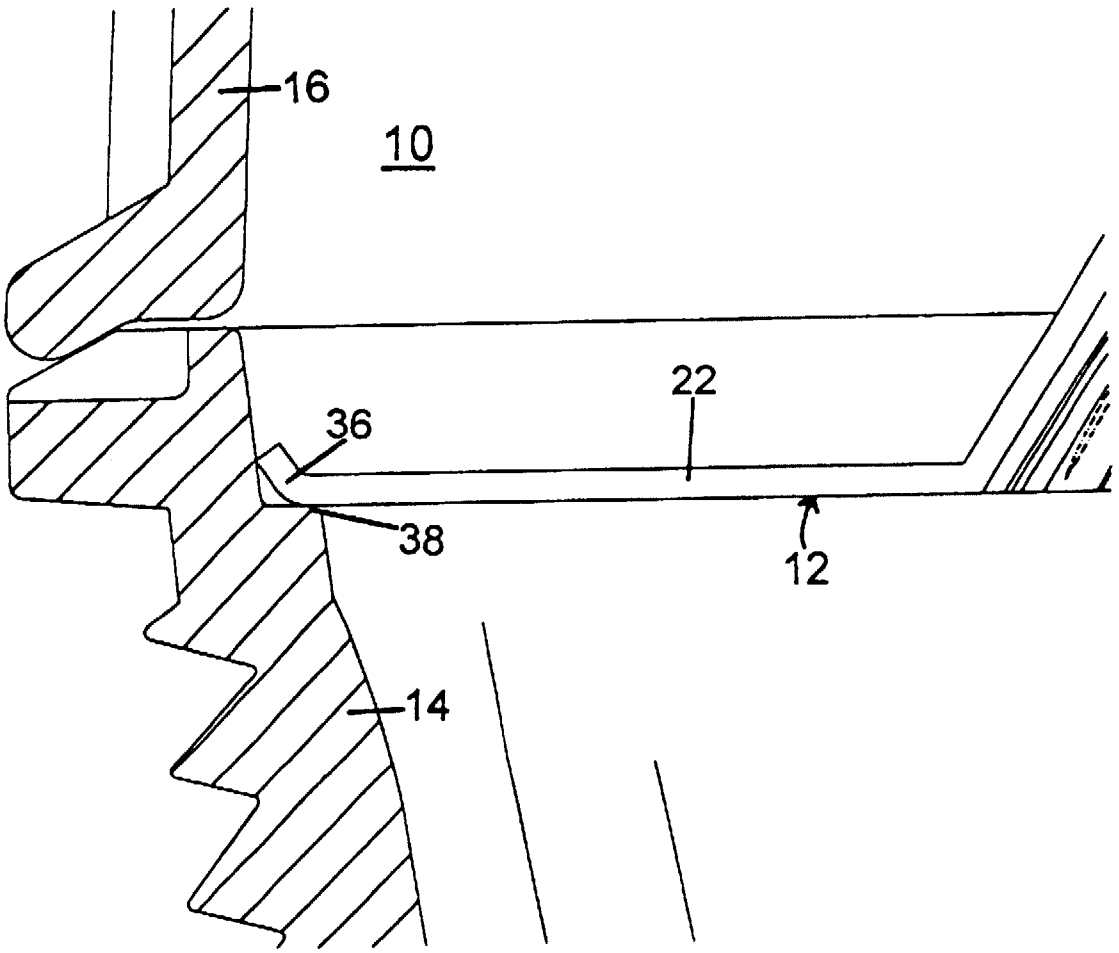
FIG. 4 is an enlarged fragmentary view illustrating a compression fit engagement of the perforated reflector with the ornamental roadway luminaire in accordance with the present invention of FIG. 1.

Referring also to FIGS. 2–4, perforated reflector 12 includes a substantially flat outwardly extending circular rim 20, a sloped, vertically extending, fluted sidewall 22, a generally flat upper portion 24 and a centrally disposed upper peaked portion 26 sloped at about 24° when measured from the horizontal. The reflector rim 20 has a selected diameter as needed corresponding to the size of the lower body refractor 14 of the ornamental luminaire 10. As illustrated and described with respect to FIGS. 8 and 9, the perforated reflector 12 is formed of a sheet metal material having a predetermined thickness and being perforated with generally uniformly spaced apart apertures 30 of a selected diameter and selected density. A hydroforming technique is used to form the sheet metal material into the predefined reflector shape and stretch the generally uniformly spaced apart apertures 30 to provide elongated apertures 32 on the sloped, fluted sidewall 22.

The vertically extending, fluted sidewall 22 is sloped at about 59° when measured from the Nadir for reflecting lamp illumination into the lower portion of the refractor 14. The sidewall 22 of the perforated reflector 12 is fluted defined by grooves 34 so that reflected light from the surface of the reflector 12 will minimally be redirected into the center of the lamp 18, such as, a high pressure sodium (HPS) lamp. This technique has been well proven to reduce the arc tube voltage rise that normally occurs with a HPS lamp if a large amount of illumination are focused on this type of lamp arc tube.

The fluting also creates a way of bypassing the envelope of the lamp 18 and reducing absorption losses when light is passed through the walls of the envelope. The result is a higher overall luminaire efficiency when using lamps other than HPS due to less absorption loss, and for a HPS lamp with fewer field problems due to a cycling characteristic common in HPS lamps when too much light is focused through the arc tube.

Referring to FIG. 3, the rim 20 of the perforated reflector 12 contains a series of outwardly extending positioning tab portions 36 arranged for press-fit engagement within the ornamental luminaire 10. For example, six tab portions 36, each 6 mm wide by 1 mm in length extend outward away from the center of the reflector 12 and oriented at 60° on center. As shown in FIG. 4, each tab 36 is designed to create an interference fit above a predetermined prism area of the refractor body 16 of the ornamental luminaire 10. The tabs 36 are designed to deform and press fit the reflector 12 into position with the refractor body 14 that is formed, for example of an acrylic (PMMA), or polycarbonate. This allows the reflector 12 to remain in compressed fit engagement with refractor body 14 until the reflector 12 needs to be removed, such as for luminaire maintenance or to replace an aged or defective lamp 18.

The diameter and shape of reflector rim 20, and tab size and the number of tabs 36 may be modified depending on the diameter of the selected refractor body 14 into which the perforated reflector 12 is provided in press-fit engagement.

The lower refractor body 14 can be made of, for example, Borosilicate glass, lighting grade polycarbonate such as Bayer LTG 3123-1112, LTG 2623-1112, or GE LEXAN® 243-112, or lighting grade acrylics such as AtoHaas V825 UVA5A, or ICI CP75 UVA. The lower refractor body 14 is typically designed to produce any one of the IES Type I to V distributions, but the Type II, III and Type V distributions are most commonly applied when the ornamental luminaires 10 are used for street lighting.

The upper top 16 of the ornamental luminaire 10 may be made of the same materials as for the lower refractor body 14 and may have a clear smooth or textured surface on the interior and exterior; or internal reflection prism pattern (not shown) only on the exterior surface of the top 16. The internal reflection prisms can only work effectively using clear or transparent materials. Pigmented materials, etched and textured treatments can be used on tops 16 and while creating excellent upward component efficiency, will cause the overall luminaire efficiency to be reduced due to additional absorption within the material.

The assembly of ornamental luminaire 10 is made when the reflector 12 is press fit into a ledge 38 of the lower refractor body 14 above the interior prisms and the tabs 36 deform into an interference fit at a predetermined location above the refractor body and lamp center location. The upper top 16 of the ornamental luminaire 10 is then placed above the perforated reflector 12 and either bonded into position or held by its own weight. A decorative clamp band (not shown) may also be used to assemble the ornamental luminaire 10. The perforated reflector 12 remains in place until either a relamping is required or luminaire maintenance is needed.

Figure 5:
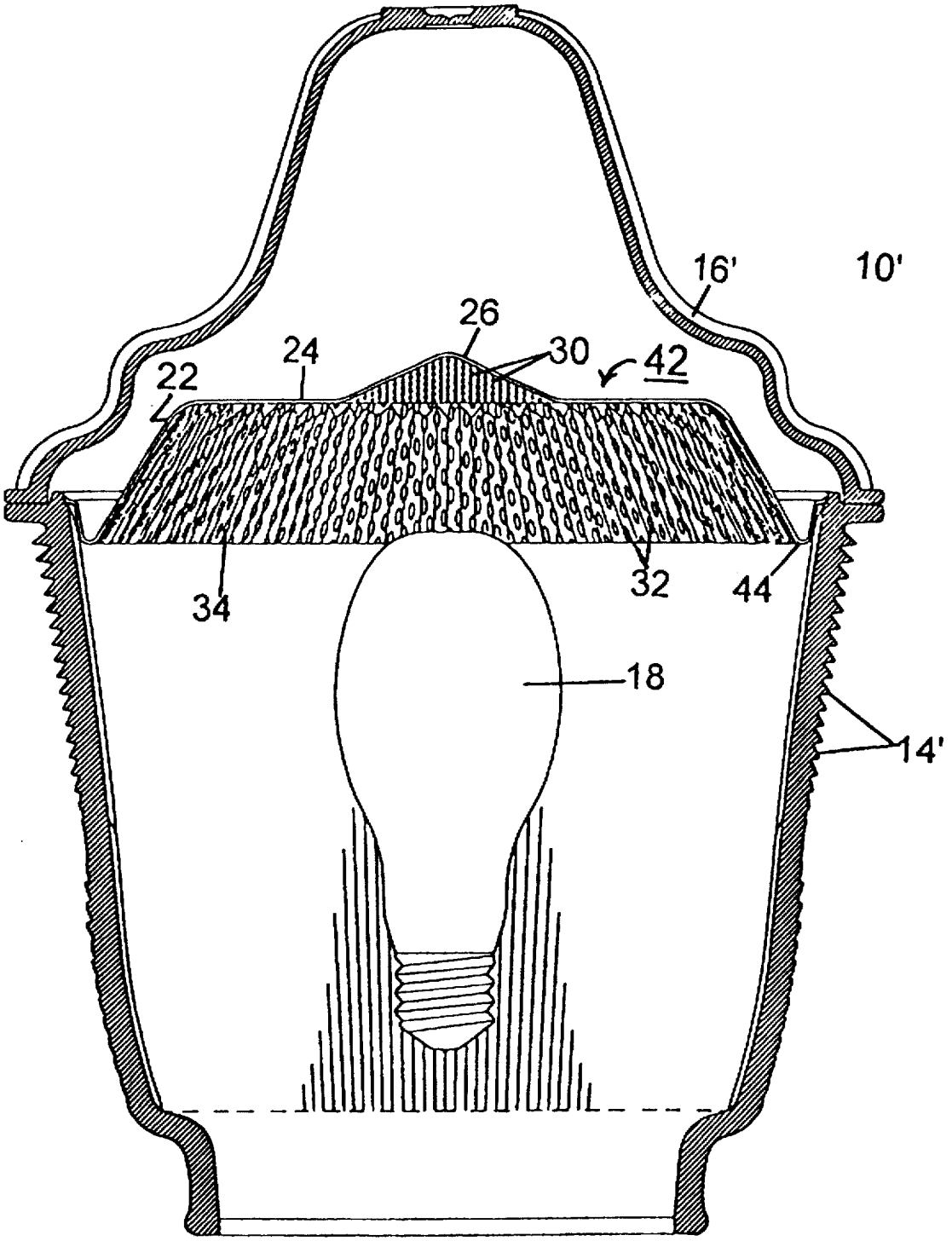
FIG. 5 is a sectional view of an alternative perforated reflector in accordance with the present invention shown used with a different traditional glass type of street luminaire.
Figure 6:
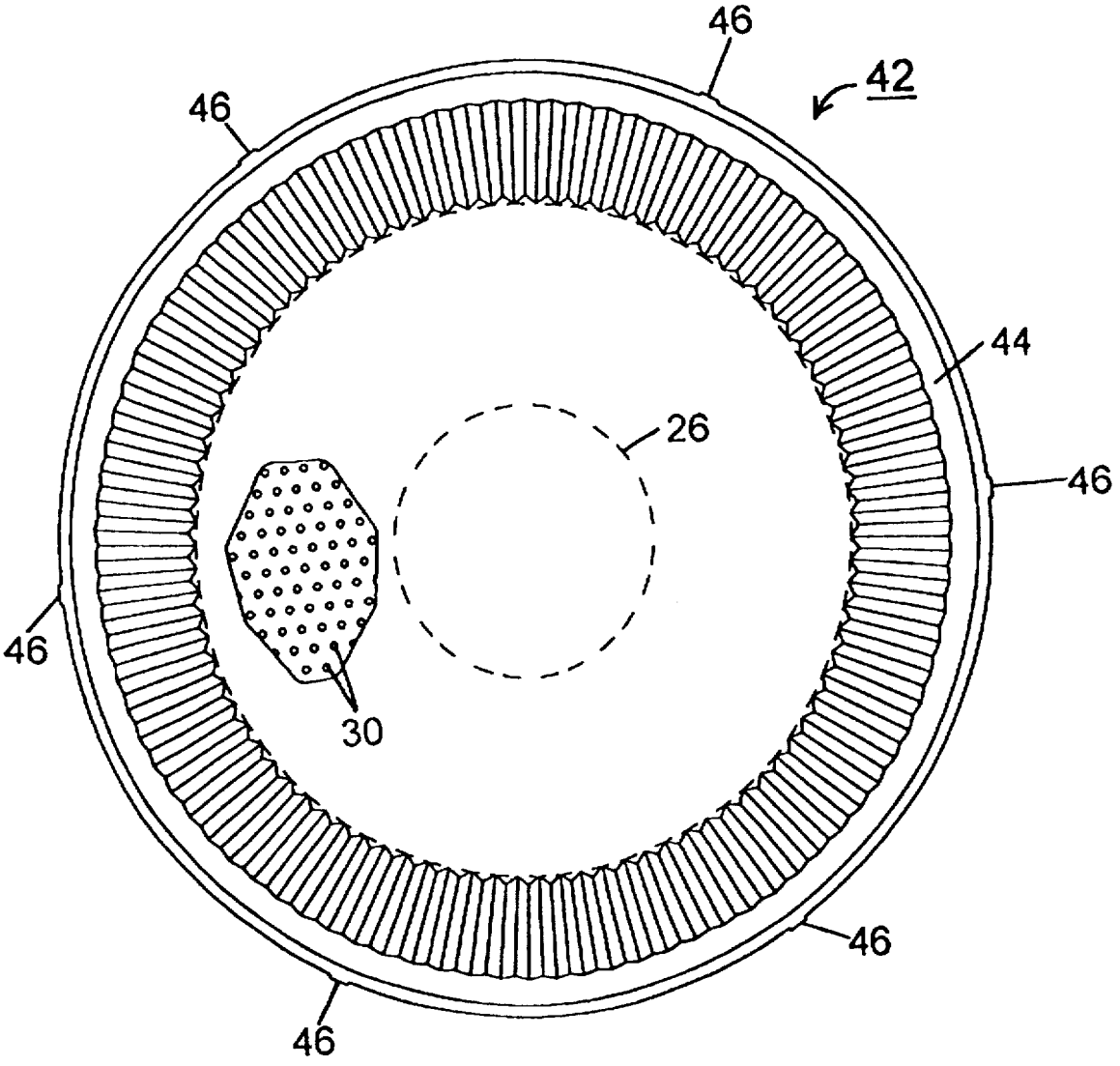
FIG. 6 is a partly schematic top plan view of the alternative perforated reflector including a only detailed portion showing perforations which included throughout the entire perforated reflector in accordance with the present invention of FIG. 5.
Figure 7:
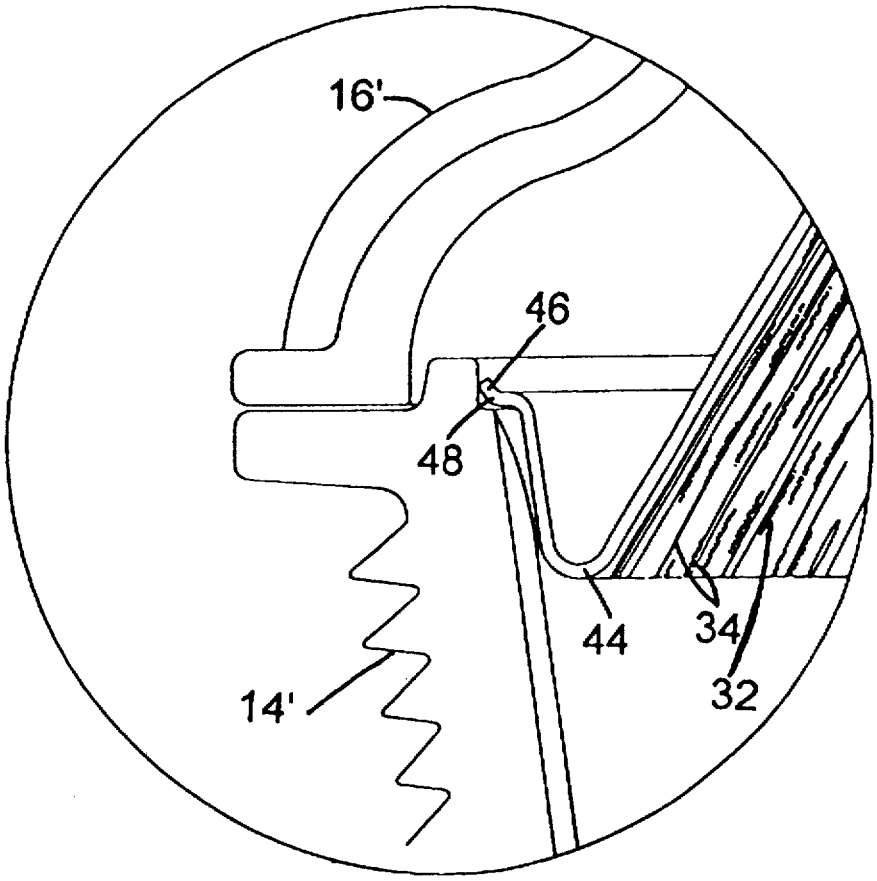
FIG. 7 is an enlarged fragmentary view illustrating a compression fit engagement of the alternative perforated reflector with the glass type of street luminaire in accordance with the present invention of FIG. 5.

Referring now to FIGS. 5–7, an alternative perforated reflector 42 is shown together with a different traditional glass type of street luminaire 10'. The same reference characters as used in FIGS. 1–4 with perforated reflector 12 are used for similar or identical portions of perforated reflector 42. A generally U-shaped rim portion 44 of the perforated reflector 42 includes a series of outwardly extending positioning tab portions 46 arranged for press-fit engagement on an outwardly extending ledge 48 within the ornamental luminaire 10'. The tabs 46 are designed to deform and press fit the reflector 42 into position with the refractor body 14' formed of glass.

Figure 8:
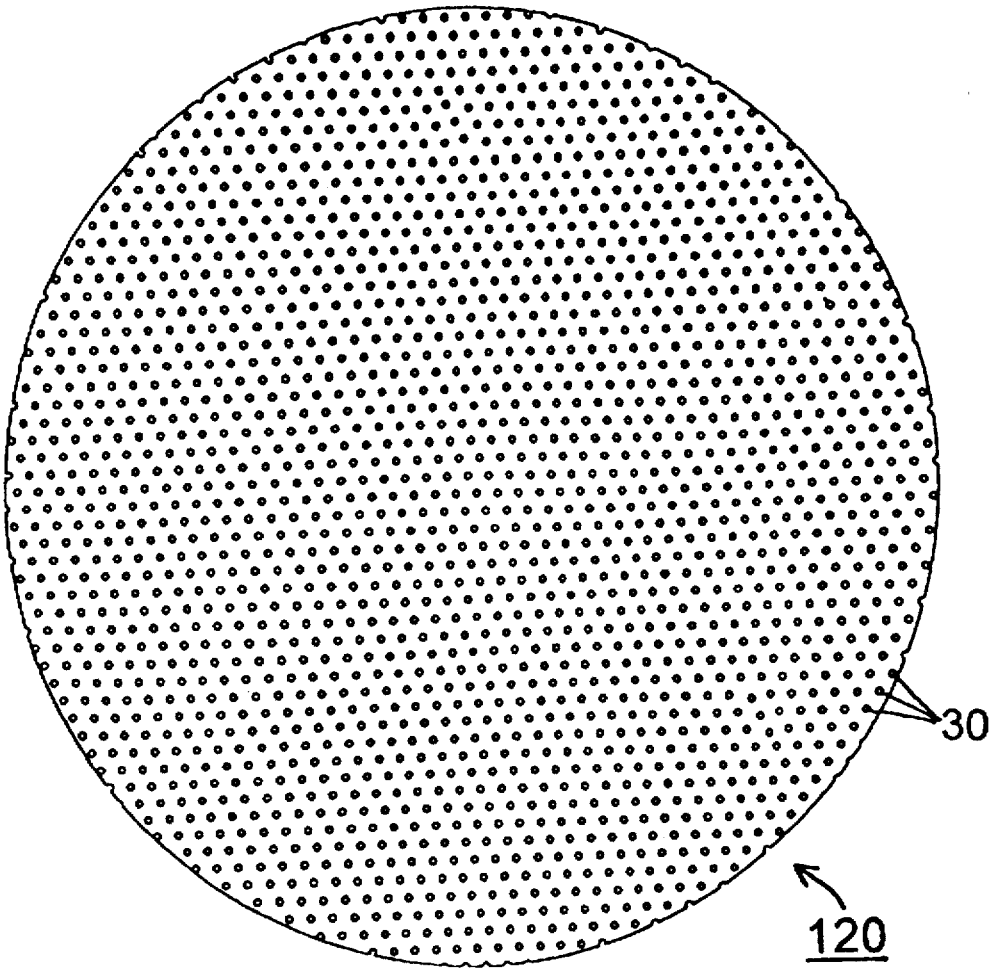
FIG. 8 is a plan view of an exemplary perforated sheet metal member used to form the perforated reflector of FIG. 1 and the alternative perforated reflector of FIG. 5.
Figure 9:
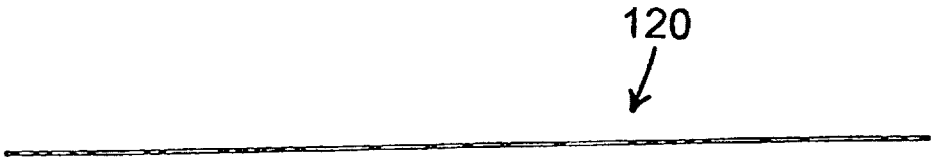
FIG. 9 is a side view of the perforated sheet metal member of FIG. 8.

Referring now to FIGS. 8 and 9, there is shown reflector sheet material 120 including perforations 30 of a specified hole size and center to center location in both length and width of a reflector blank for forming the perforated reflector 12 or perforated reflector 42. The perforated reflectors 12 and 42 preferably are formed from reflector sheet material 120 of any one of the following aluminum alloys, such as 3002, 3003 and 1100-0. Each reflector 12, 42 is hydroformed into a predetermined contour that is pressed and stretched into its final shape, as shown in FIGS. 1–4 and 5–7, respectively. The reflector is trimmed via a stamping process to the desired diameter and leaving the six compression, positioning tabs 36, 46 in place in a precompression state. The compression, positioning tabs 36, 46 are sized to deform into the outstanding ledge 38, 48 on the interior surface of the lower refractor body 14, 14', respectively.

The contour or shape of perforated reflector 12 or perforated reflector 42 can be determined mathematically or by raytracing programs in relationship to the lamp 18 and lamp center location within the refractor body 14, 14'; the amount of upward illumination component emitted into the ornamental luminaire's top 16, 16' subtracting the absorption loss from the reflector material; and the amount of illumination that is selected to be reflected from upward component efficiency of the ornamental luminaire 10, 10', back toward the lower refractor portion 14, 14' of the luminaire.

For example, selecting a 1.25 mm thickness aluminum sheet, perforated with 2.2 mm diameter holes on a 6 mm center to center location will allow the perforated reflector 12 or 42 of 16" in diameter to be hydroformed to the predetermined reflector contour as shown in FIGS. 1–4 and FIGS. 5–7. This contour will reflect a 66 (sixty-six) percent portion of the upward component normally emitted from the lamp 18 to be reflected back downward into the lower predetermined refractor body 14, 14'. A portion of the lamp's illumination will be absorbed by the reflector material and will range from 10 (ten) to 30 (thirty) percent based on the material quality and finish. The result will be an increase of 25 (twenty-five) to 30 (thirty) percent from the lower predetermined refractor portion of the ornamental luminaire. The perforated reflector 12 or 42 with the-above described perforation patterns will allow 10 (ten) to 15 (fifteen) percent of the lamp's illumination into the upward component to be released into the top of the ornamental luminaire.

When the top 16' of this ornamental luminaire is constructed with a series of predetermined internal reflection prisms as shown in FIG. 5, the top appears to glow uniformly with a 10 (ten) to 20 (twenty) percent overall upward component. If the top of this ornamental luminaire is constructed with a decorative "stippled" texture of FIG. 1, the top 16 appears to glow uniformly with a 15 (fifteen) percent overall upward component. It should be understood that the perforation pattern can be modified to provide more or less illumination into the upward component and thereby resulting in an effect of the lower component by changing the center to center spacing of the perforations 30 and the size of the perforations 30 and 32.

The thickness of the aluminum sheet is important when determining the amount of enlongation or stretch of each perforation 30 providing elongated apertures 32 in the sidewall 22 during the hydroforming process. Each perforation 30 elongates when stretched over the relatively vertical sidewall 22 on the reflector 12, 42. Since each perforation 32 has the potential to tear if the aluminum sheet metal material is stretched too far, it is believed that each perforation 30 can be elongated by 30 (thirty) to 50 (fifty) percent for each inch or 2.56 cm of vertical wall, with a 1 mm wall thickness without causing the aluminum sheet material 120 to tear when hydroforming predetermined perforated reflector contour.

Obviously other contours, shapes and perforation density can be obtained within the limits of the grade of aluminum and the ability the particular to stretch during the hydroforming process and the amount of uplight component wanted for a specific application, utilizing these ornamental luminaires 10, 10'.

While the present invention has been described with reference to the details of the embodiments of the invention shown in the drawing, these details are not intended to limit the scope of the invention as claimed in the appended claims.

What is claimed is:

1. A reflector for an ornamental luminaire comprising:

a member formed of a metal material, said metal member having a predetermined thickness and being perforated with spaced apart apertures of a selected diameter and a selected density;

said metal member having a predefined reflector shape, said spaced apart apertures and said predefined reflector shape arranged for providing control of both an upper illumination distribution and a lower illumination distribution; and wherein said metal member perforated with spaced apart apertures of approximately 2.2 mm diameter on approximately 6 mm center to center location.

2. A reflector for an ornamental luminaire comprising:

a member formed of a metal material, said metal member having a predetermined thickness and being perforated with spaced apart apertures of a selected diameter and a selected density;

said metal member having a predefined reflector shape, said spaced apart apertures and said predefined reflector shade arranged for providing control of both an upper illumination distribution and a lower illumination distribution; and wherein said sloped, vertically extending, sidewall is fluted and includes elongated apertures.

3. A reflector for an ornamental luminaire as recited in claim 2 wherein said reflector metal member includes a plurality of positioning tab portions arranged for press-fit engagement within the ornamental luminaire.

4. A reflector for an ornamental luminaire as recited in claim 3 wherein the ornamental luminaire includes a lower ornamental luminaire body having an interior surface and wherein said positioning tab portions have a predetermined size to deform into an outwarding extending ledge on the interior surface of the lower ornamental luminaire body.

5. A reflector for an ornamental luminaire as recited in claim 2 wherein a hydroforming technique is used to form the metal member into the predefined reflector shape.

6. A reflector for an ornamental luminaire as recited in claim 5 wherein a stamping process is used to trim the metal member to a desired diameter and to provide a plurality of positioning tab portions in a precompression state.

7. A reflector for an ornamental luminaire comprising:

a member formed of a metal material, said metal member having a predetermined thickness and being perforated with spaced apart apertures of a selected diameter and a selected density;

said metal member having a predefined reflector shape, said spaced apart apertures and said predefined reflector shape arranged for providing control of both an upper illumination distribution and a lower illumination distribution; and wherein said metal member predetermined thickness is approximately 1.25 mm.

8. A reflector for an ornamental luminaire as recited in claim 7 wherein said metal member has substantially uniformly spaced apart apertures of said selected diameter and said selected density.

9. A reflector for an ornamental luminaire as recited in claim 7 wherein said predefined reflector shape includes a generally circular outer rim portion, and a sloped, vertically extending, sidewall.

10. A reflector for an ornamental luminaire as recited in claim 9 wherein said predefined reflector shape includes a generally flat upper portion with a centrally disposed upper peaked portion, said upper peaked portion located above a lamp in the ornamental luminaire.

11. A reflector for an ornamental luminaire as recited in claim 7 wherein said metal member material is an aluminum alloy.

12. A reflector for an ornamental luminaire as recited in claim 11 wherein said metal member material is a selected one of aluminum alloys, 3002, 3003 and 1100-0.

* * * * *